US006322314B1

(12) United States Patent
Sofy

(10) Patent No.: US 6,322,314 B1
(45) Date of Patent: Nov. 27, 2001

(54) PRESS TRANSFER BAR

(75) Inventor: Hugh Sofy, Troy, MI (US)

(73) Assignee: HMS Products, Co., Troy, MI (US)

( * ) Notice: Subject to any disclaimer, the term of this patent is extended or adjusted under 35 U.S.C. 154(b) by 0 days.

(21) Appl. No.: 09/532,797

(22) Filed: Mar. 21, 2000

Related U.S. Application Data

(63) Continuation-in-part of application No. 09/443,585, filed on Nov. 19, 1999, now Pat. No. 6,196,044.

(51) Int. Cl.[7] ..... B65G 49/00

(52) U.S. Cl. ..... 414/751.1; 72/405.13; 72/405.16; 198/468.6

(58) Field of Search ..... 414/749.1, 749.5, 414/751.1; 72/405.01, 405.09, 405.11, 405.12, 405.13, 405.16; 198/468.2, 468.6, 468.9, 750.1

(56) References Cited

U.S. PATENT DOCUMENTS

| | | | | |
|---|---|---|---|---|
| 3,757,961 | * | 9/1973 | Jacobs | 414/751.1 |
| 4,012,938 | | 3/1977 | Brandstrom | 72/422 |
| 4,398,408 | | 8/1983 | Wisebaker et al. | 72/422 |
| 4,852,381 | | 8/1989 | Sofy | 72/405 |
| 4,895,013 | | 1/1990 | Sofy | 72/405 |
| 5,074,141 | | 12/1991 | Takeuchi | 72/405 |
| 5,771,561 | | 6/1998 | Hofele | 29/563 |

* cited by examiner

*Primary Examiner*—Donald W. Underwood
(74) *Attorney, Agent, or Firm*—Howard & Howard

(57) ABSTRACT

A mounting plate (16) for attaching a finger (14) to extend in a cantilevered fashion from a transfer bar (12) in a work piece transfer assembly for a press including a reciprocating member and a series of longitudinally spaced in-line stations wherein each station is a further progression of a work piece forming process. The finger (14) includes a shank (18) and a pair of shank fasteners (16) extend downwardly through the transfer bar (12) to threadedly engage the shank (18) and force the shank (18) against the bottom (28) of the transfer bar (12). A pair of columns (22) extend upwardly above the transfer bar (12) to engage the heads (20) of the shank fasteners (16). Each of the columns (22) include a relief portion (32) defining a shoulder engaging the bottom (28) of the transfer bar (12) as the relief portion (32) extends into the bottom (28) of the transfer bar (12).

5 Claims, 3 Drawing Sheets

PRESS TRANSFER BAR

RELATED APPLICATION

This application is a continuation-in-part of application Ser. No. 09/443,585 filed Nov. 19, 1999 in the name of the inventor named herein and now U.S. Pat. No. 6,196,044.

BACKGROUND OF THE INVENTION

1. Field of the Invention

The subject invention relates to work piece transfer assembly for a press including a reciprocating member and a series of longitudinally spaced in-line stations wherein each station is a further progression of a work piece forming process and, more specifically, to a mounting system for a finger which engages and moves the work piece.

2. Description of the Prior Art

Such work piece transfer assemblies usually include a transfer bar and a motion transmitting mechanism for moving the bar inward, outward, and longitudinally for transferring work pieces through the press. A finger is attached to the transfer bar for engaging and transferring work pieces through the press. Typical prior art assemblies are disclosed in U.S. Pat. No. 4,833,908 to Sofy et al; U.S. Pat. No. 4,852,381 and U.S. Pat. No. 4,895,013, both to Sofy, the inventor herein, and U.S. Pat. No. 5,074,141 to Takeuchi.

An objective in the construction of such fingers is that they provide the requisite strength yet remain light in weight.

SUMMARY OF THE INVENTION AND ADVANTAGES

Accordingly, the subject invention provides the requisite strength and light in weight. The invention is implemented in a work piece transfer assembly for a press including a reciprocating member and a series of longitudinally spaced in-line stations wherein each station is a further progression of a work piece forming process. The assembly in which the invention is implemented comprises a transfer bar, a motion transmitting mechanism for moving the bar inward, outward, and longitudinally for transferring work pieces through the press, and a finger for attachment to the transfer bar for engaging and transferring work pieces through the press. The assembly is characterized by a shank fastener extending downwardly through said transfer bar and including threads to threadedly engage the finger for attaching the finger to the transfer bar to extend in a cantilevered fashion to a distal end.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
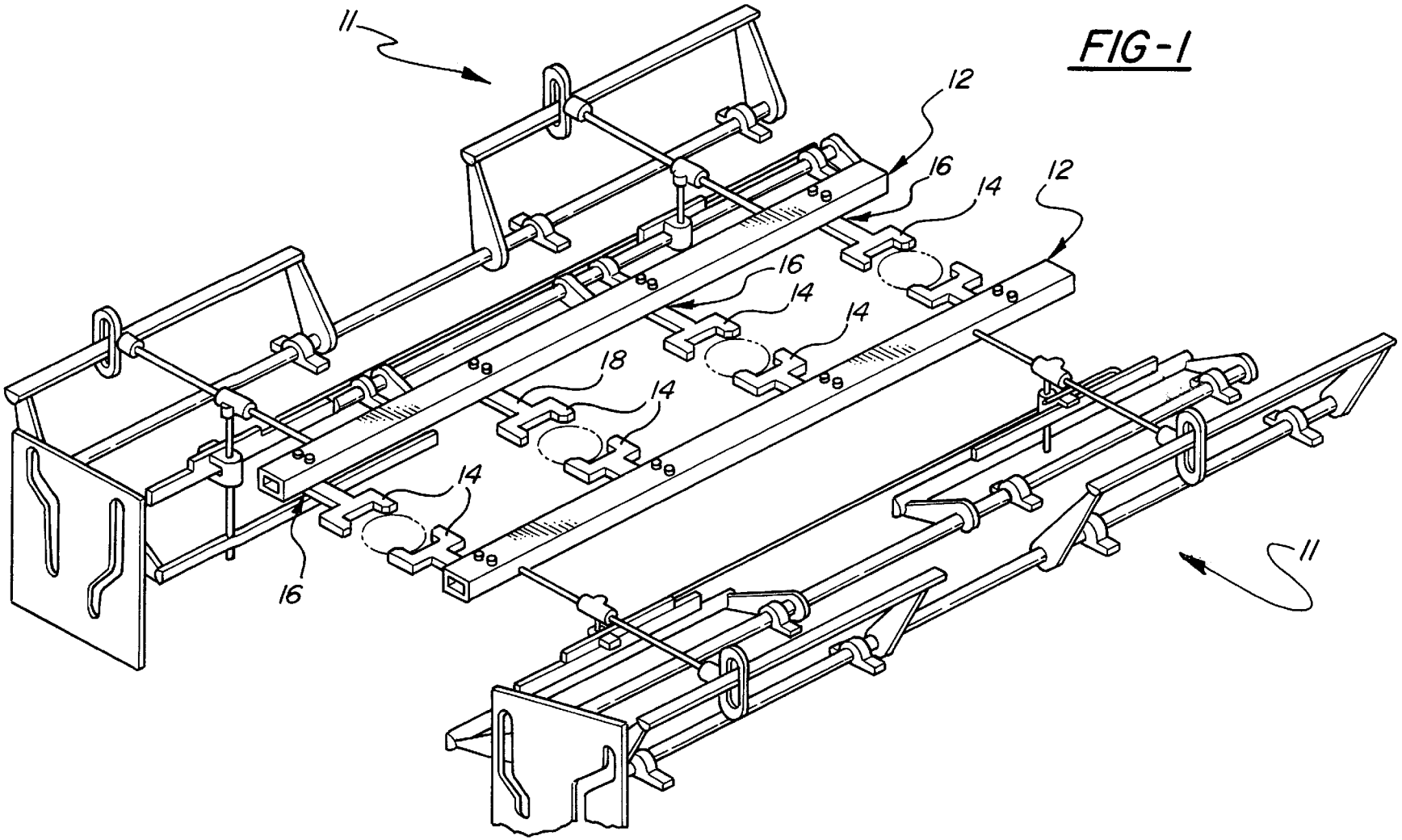
FIG. 1 is a perspective view of a transfer mechanism including the subject invention.
Figure 2:
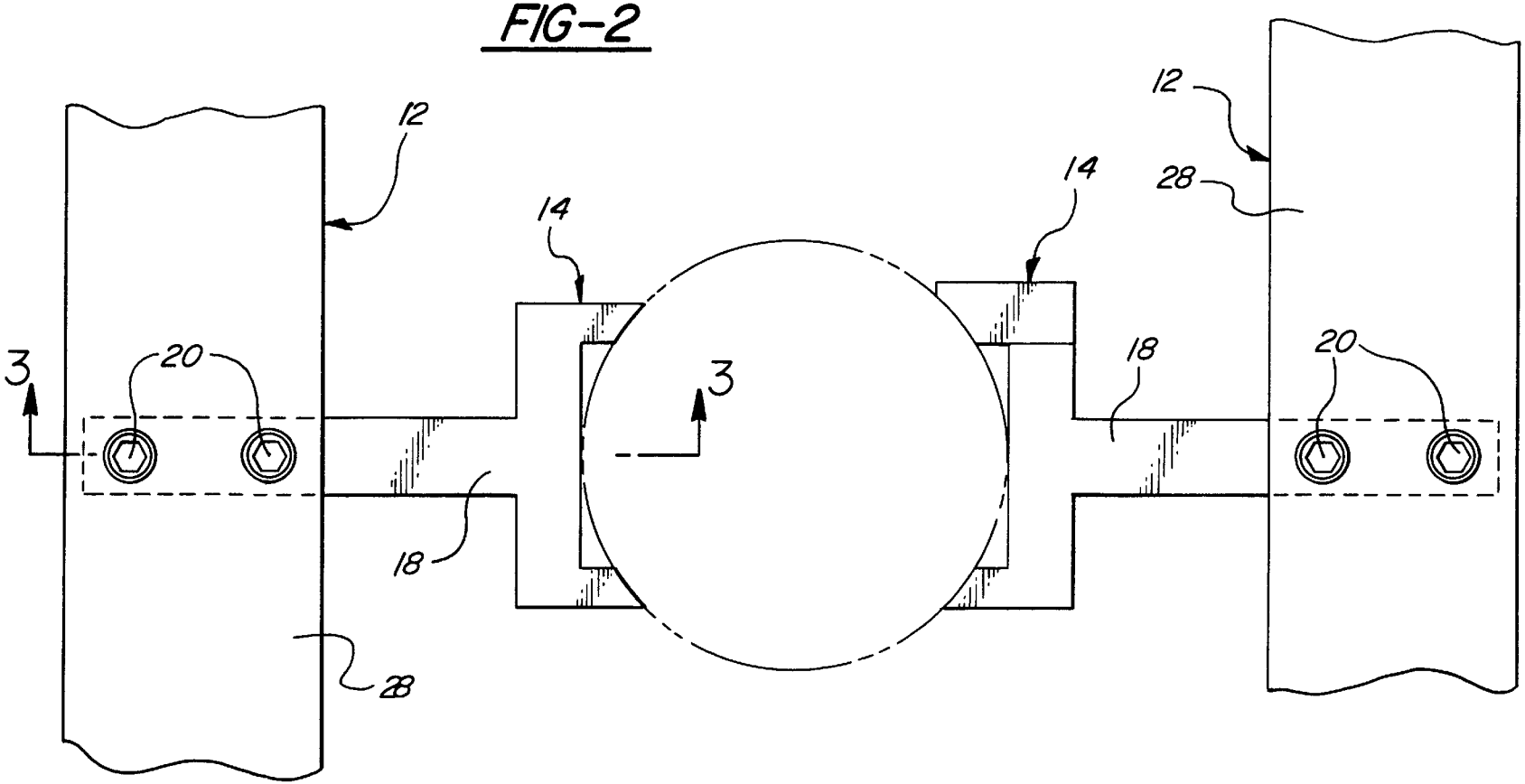
FIG. 2 is a plan view of a pair of spaced transfer bars combined with the subject invention.

Referring to the Figures, wherein like numerals indicate like or corresponding parts throughout the several views, a work piece transfer assembly for a press including a reciprocating member and a series of longitudinally spaced in-line stations wherein each station is a further progression of a work piece forming process is shown in FIG. 1. The transfer assembly is specifically adapted for operation with a press of the type including a reciprocating member, i.e., a ram, and a series of in-line die stations wherein each station is a further progression of the work piece forming process. A plurality of work pieces are shown in phantom in FIG. 1 and singularly in FIG. 2.

The transfer assembly includes a transfer bar, generally indicated at 12, and a motion transmitting mechanism, generally shown at 11, for moving the transfer bar 12 inward, outward, and longitudinally for transferring work pieces through the press. The transfer mechanism may be of the type well known in the art as described in any one of the aforementioned Sofy patents. A finger 14 is attached to the transfer bar 12 for engaging and transferring work pieces through the press.

The assembly is characterized by a shank fastener 16 extending downwardly through said transfer bar 12 and including threads 17 to threadedly engage the finger 14 for attaching the finger 14 to the transfer bar 12 to extend in a cantilevered fashion to a distal end, the distal end being forked to engage a work piece. The finger 14 includes a shank 18 extending transversely of the transfer bar 12. The assembly actually includes two of the shank fasteners 16 aligned along the shank 18 and each shank fastener 16 includes a head 20.

Figure 3:
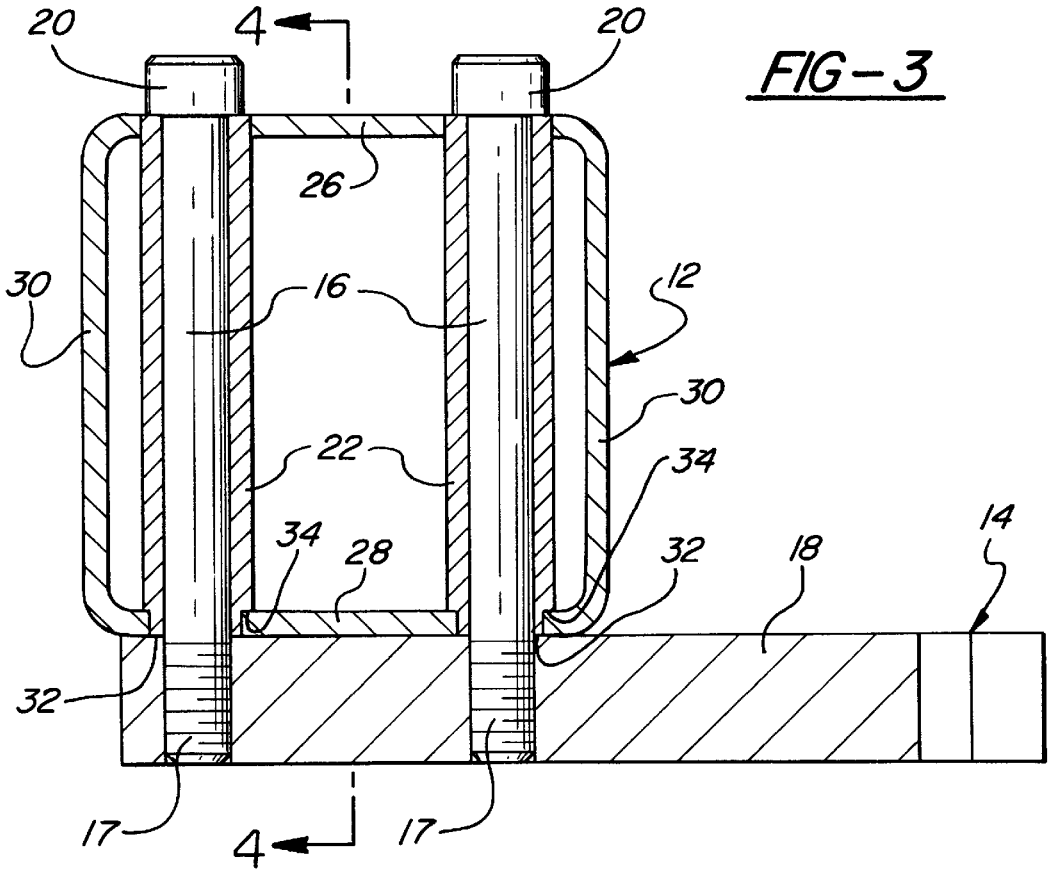
FIG. 3 is a cross sectional view taken along line 3—3 of FIG. 2.
Figure 4:
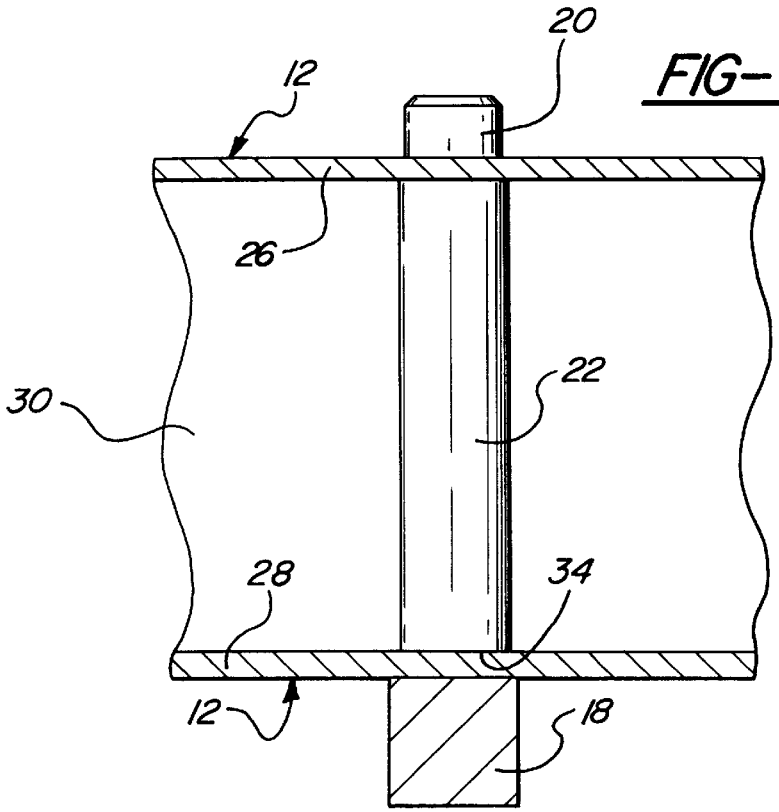
FIG. 4 is a cross sectional view taken along line 4—4 of FIG. 3.

As best shown in FIGS. 3 & 4, the transfer bar 12 is a hollow tubular member. A pair of or two tubular columns 22 are disposed inside of the hollow transfer bar 12 in compression between the head 20 of the shank fasteners 16 and the bottom 28 of the transfer bar 12. The transfer bar 12 has a top 26 and a bottom 28 interconnected by two sides 30. As the shank fasteners 16 extend downwardly through the transfer bar 12 to threadedly engage the shank 18 and to force the shank 18 against the transfer bar 12, there is a clearance between the bottom of the tubular columns 22 and the exterior of the bottom 28 of the transfer bar 12. The shank fasteners 16 clamps together the columns 22, the bottom 28 of the transfer bar 12, and the shank 18.

The columns 22 extend upwardly above the top surface 26 of the transfer bar 12 to engage the heads 20 of the shank fasteners 16 in spaced relationship to the top 26 of the transfer bar 12. Each of the columns 22 include a relief portion 32 defining a shoulder 34 engaging the interior of the bottom 28 of the transfer bar 12 as the relief portion 32 extends into the bottom 28 of the transfer bar 12. In order to provide the clearance between the bottom of the columns 22 and the shank 18, the relief portion 32 terminates short of the shank 18 to allow the shank 18 to be forced against the bottom 28 of the transfer bar 12.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A work piece transfer assembly for a press including a reciprocating member and a series of longitudinally spaced in-line stations wherein each station is a further progression of a work piece forming process, said assembly comprising:

a hollow transfer bar (12);

a motion transmitting mechanism for moving said bar (12) inward, outward, and longitudinally for transferring work pieces through the press; and a finger (14) attached to said transfer bar (12) for engaging and transferring work pieces through the press;

said assembly characterized by a shank fastener (16) extending downwardly through said transfer bar (12) and including threads (17) to threadedly engage said finger (14) for attaching said finger (14) to said transfer bar (12) to extend in a cantilevered fashion to a distal end;

said shank fastener (16) including a head (20), a column (22) disposed inside of said hollow transfer bar (12) in compression between said head (20) of said shank fastener (16) and said bottom (28) of said transfer bar (12).

2. An assembly as set forth in claim 1 wherein said finger (14) includes a shank (18) extending transversely of said transfer bar (12) and including two of said shank fasteners (16) and two of said columns (22) aligned along said shank (18) to force said shank (18) against said transfer bar (12).

3. An assembly as set forth in claim 2 wherein said columns (22) extend upwardly above said transfer bar (12) to engage said heads (20) of said shank fasteners (16).

4. An assembly as set forth in claim 3 wherein each of said columns (22) include a relief portion (32) defining a shoulder (34) engaging said bottom (28) of said transfer bar (12) as said relief portion (32) extends into said bottom (28) of said transfer bar (12).

5. An assembly as set forth in claim 4 wherein said relief portion (32) terminates short of said shank (18) to provide clearance for said shank (18) to be forced against said bottom (28) of said transfer bar (12).

* * * * *